United States Patent [19]

Seglias

[11] 4,315,712

[45] Feb. 16, 1982

[54] LOADING METHOD AND DEVICE FOR FEEDING WASTE-FILLED CONTAINERS INTO A ROTARY INCINERATOR

[75] Inventor: Werner Seglias, Erlenbach, Switzerland

[73] Assignee: Von Roll AG, Gerlafinger, Switzerland

[21] Appl. No.: 83,283

[22] Filed: Oct. 10, 1979

[30] Foreign Application Priority Data

Oct. 13, 1978 [CH] Switzerland ..... 10673/78

[51] Int. Cl.[3] ..... F23K 3/00

[52] U.S. Cl. ..... 414/149; 110/246; 110/346; 414/173; 414/198; 414/786

[58] Field of Search ..... 414/149, 198, 421, 786; 110/246, 255, 289, 346

[56] References Cited

U.S. PATENT DOCUMENTS 3,572,524 3/1971 Muckenheim ..... 414/149

3,986,624 10/1976 Cates et al. ..... 414/198 X

*Primary Examiner*—Robert G. Sheridan

*Attorney, Agent, or Firm*—Weingarten, Schurgin & Gagnebin

[57] ABSTRACT

A loading method and loading device for feeding waste-filled containers into a rotary incinerator, wherein open topped containers are filled with liquid, pasty, or solid waste materials and are fed sequentially using a reciprocating ram via a slide onto a loading and dumping platform. This loading and dumping platform projects from the stationary incinerator inside wall into the drum of the rotary incinerator. Each container placed on the loading and dumping platform is allowed to stand for one loading time interval during which a portion of the combustible volatile components of the waste contents is gasified and burned by the heat radiating from the fire in the drum. After this initial combustion, the reciprocating ram feeds the next container in sequence onto the loading and dumping platform and, at the same time, tips the first container off the platform into the drum. The combustible waste residue of this tipped container spreads out on the lower wall of the drum and burns, releasing further heat.

16 Claims, 5 Drawing Figures

LOADING METHOD AND DEVICE FOR FEEDING WASTE-FILLED CONTAINERS INTO A ROTARY INCINERATOR

FIELD OF THE INVENTION

This invention relates to a loading method and device for feeding waste-filled containers into a rotary incinerator. Open topped containers are brought to a loading level and by means of a mechanical ram sequentially fed through the incinerator wall into a rotary incinerator.

BACKGROUND OF THE INVENTION

In known loading methods and devices for feeding waste-filled containers into a rotary incinerator, the containers, consisting of open topped barrels and tubs, are pushed by means of a ram along a slide which extends through the inner wall of a rotary incinerator, and are tipped in a single motion into the drum of the incinerator. These containers are filled with solid, pasty, or liquid wastes, often from industrial origins. The solid wastes usually become pasty or fluid under the influence of incinerator heat, while the pasty wastes can become either liquid when heated or remain as is. As a container or barrel is emptied, the combustible material emerges and spreads out in the rotary incinerator. A relatively large portion of the lower surface of the incinerator drum is rapidly covered by combustible waster material. The intensive heat prevailing in the incinerator drum produces a rapid burning of the waste material. In particular, the burning waste material, spread over a relatively large surface area, creates a sudden, uncontrollable release of heat and produces a correspondingly steep, high temperature peak. Such high temperatures exert considerable stress on the rotary incinerator, albeit for a short time. Correspondingly, the air available for combustion is frequently insufficient so that the lack of oxygen produces soot and unburned gas, by-products which are unacceptable in view of environmental protection laws governing smoke stack emissions.

Large solid combustible wastes which become liquid or pasty with heat behave essentially the same as waste materials which were initially liquid; they spread over large areas of the rotary incinerator, create sudden uncontrollable heat releases, and produce high temperature peaks. Loose granular wastes and chunky wastes behave similarly to liquid wastes or solid wastes which have become liquid.

One known method to avoid these disadvantages is to first pump the liquid waste contents of the container into a holding tank and then again pump the material from this tank into the rotary incinerator. However, this method is not always feasible because of the variations of waste products and is quite costly in terms of equipment and operating expenses.

SUMMARY OF THE INVENTION

An object of the present invention is to overcome the disadvantages of the known loading methods and devices; that is, to provide a loading method in which a controlled uniform heat release can be achieved; to avoid the production of high temperature peaks and the concurrent thermal over-stressing of the rotary incinerator; to eliminate the undesirable soot formation; and to dispense with the costly and technically troublesome pumping of liquid or pasty wastes into a special holding tank.

In accordance with the present invention, a loading method and device is described using open topped containers which are pushed forward in a standing position on a slide by a mechanical ram. Each container is moved along the slide through the stationary incinerator end wall of the furnace and comes to a stop on a loading and dumping platform within the rotary incinerator drum. The container, standing upright on this loading platform, is exposed to heat radiating from the rotary incinerator drum for a measured time period. The combustible waste contents burn while still within the open topped container. Only after this initial combustion and vaporization of wastes is the container tipped off the loading platform into the rotary incinerator drum by the ram. In addition, the present invention describes a loading device for employing the loading method described herein. This device comprises a reciprocating ram, a slide, and a loading and dumping platform projecting sufficiently far into the incinerator drum that containers standing on the loading and dumping platform are already within the rotary incinerator drum proper.

DESCRIPTION OF THE DRAWING

The invention will be more fully understood from the following detailed description taken in conjunction with the accompanying drawing in which.

DETAILED DESCRIPTION OF THE INVENTION

Figures 1, 2:
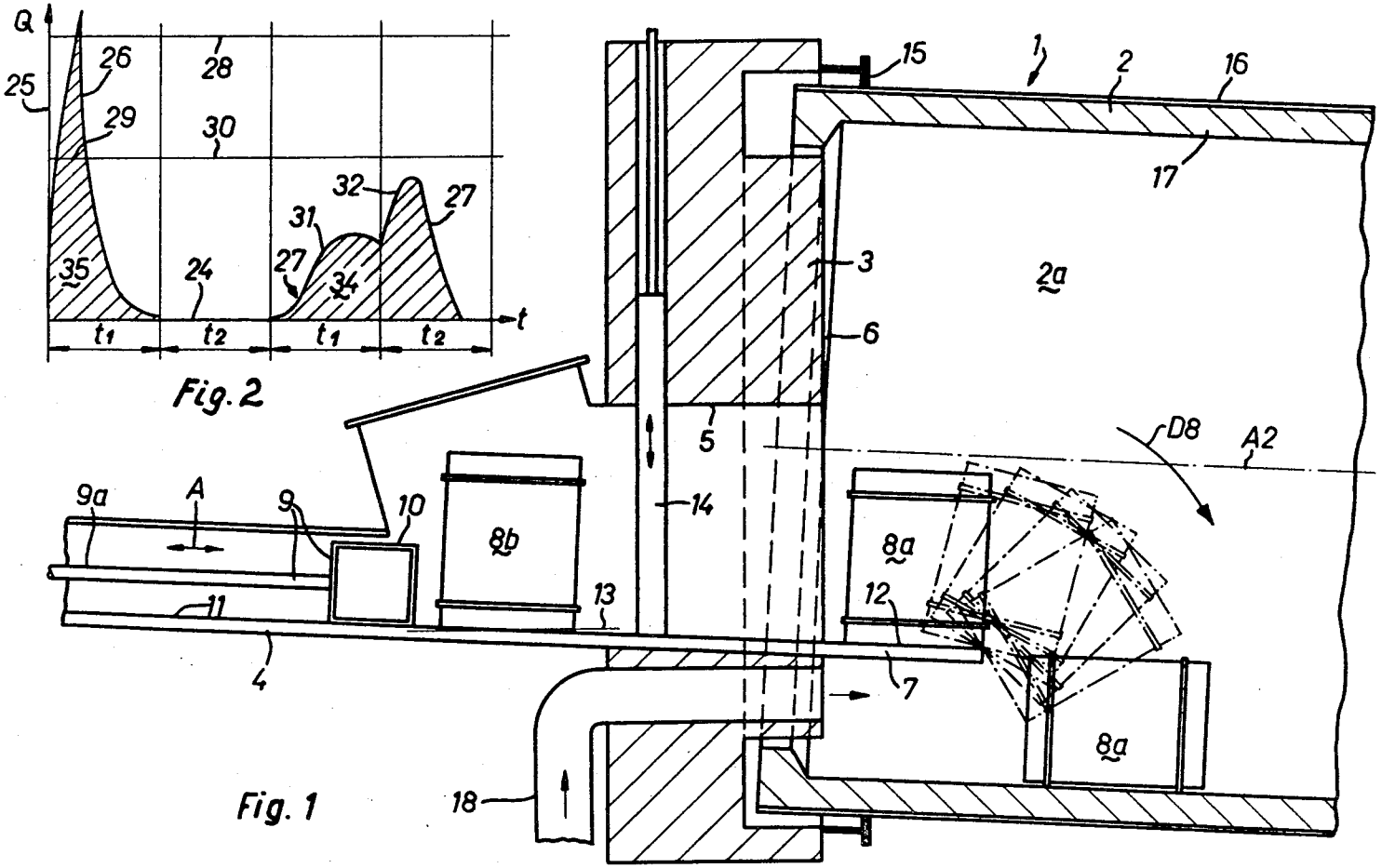
FIG. 1 is a cross-sectional view of the loading device incorporated into a rotary incinerator according to the invention.
FIG. 2 is a graph comparing the heat release during waste combustion per individual container for the previously known loading methods and for the present invention.

Referring to FIG. 1, there is shown the preferred embodiment of the loading method and the loading device according to the present invention. A rotary incinerator 1 and drum 2 are shown separated by the vertical end wall 3 and inner wall 6 located at the loading area of drum 2. A flat slide 4, sloping gently downward toward rotary incinerator 1, passes through a loading opening 5 in incinerator end wall 3 and continues beyond the inner wall 6 in the form of a loading and dumping platform 7 for the open topped barrels **8*a* and 8*b*. This loading and dumping platform 7 projects from end wall 3 and inner wall 6 and extends sufficiently far into drum 2 that barrel 8*a* is located completely inside the interior 2*a* of drum 2 which forms the actual body of rotary incinerator 1. A ram 9, reciprocating in the opposite directions as shown by double-headed arrow A, has a ram head 10 mounted on one end of a ram rod 9*a*. The ram 9 is constantly in contact with the flat sliding surface 11 of slide 4, which sliding surface merges with the flat surface 12 of the loading and dumping platform 7. The individual barrels 8*a* and 8*b* are fed sequentially in a standing position at uniform loading intervals by ram 9 along slide 4 into rotary incinerator 1. Barrels 8***a* and 8*b* are made of metal such as sheet iron and may be filled with any combination of liquid, pasty, loose, granular, or chunky wastes. Barrels 8*a* and 8*b* are sequentially brought in a standing position to a loading level 13 by means of a vertical elevator, not shown in FIG. 1 for the sake of increased clarity.

A sliding door 14, mounted vertically, displaces the end wall 3 of the furnace at the loading opening 5. Sliding door 14 may also be mounted horizontally or be attached as a flap, so long as it seals off the loading opening 5 tightly. The rotating drum of rotary incinerator 1 is completely sealed off from the stationary incinerator end wall 3 by an annular seal 15 which is indicated schematically in FIG. 1. As a rule, annular seal 15 serves to tightly seal off the end wall 3 of rotary incinerator 1. It seals any leaks present and prevents atmospheric air from entering the body 2*a* of the furnace formed by drum 2. Atmospheric air enters only when ram 9 feeds a barrel 8*a* through loading opening 5 onto the loading and dumping platform 7, requiring sliding door 14 to be raised for a short time from its closed position. Once the barrel 8*a* passes through, the sliding door 14 is quickly lowered again into its closed position. Once sliding door 14 is returned to the closed position, the barrel 8*a* is in a loading chamber which is again sealed on all sides.

Figure 5:
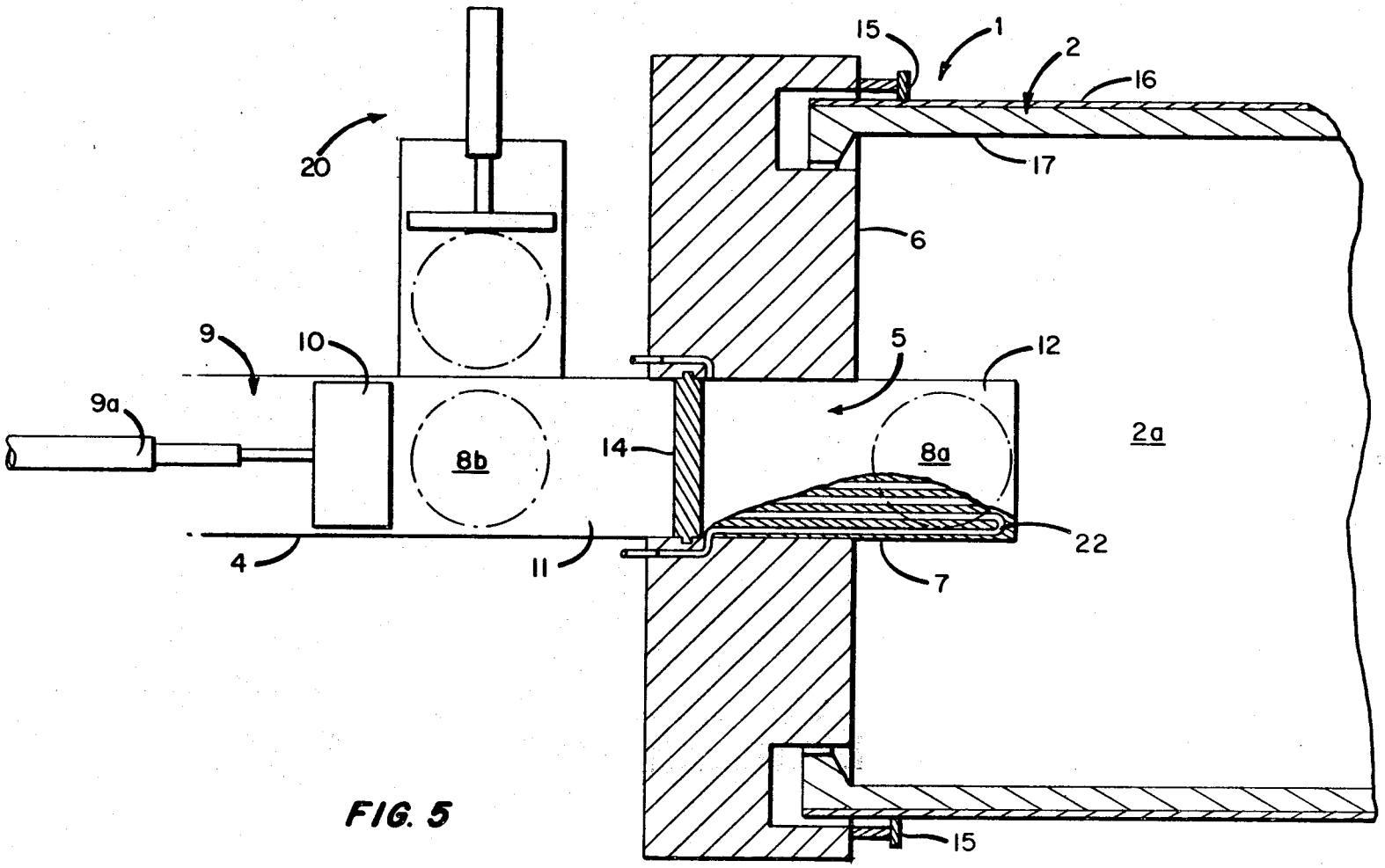
FIG. 5 is a top view of the loading device of FIG. 4.

Drum 2 of rotary incinerator 1 comprises a cylindrical jacket 16 preferably made of sheet steel, supported by a fire-proof brick lining 17. This brick lining 17 delimits the body 2*a* of rotary incinerator 1 from end wall 3 which is itself made of refractory material. An air connection 18, passing through incinerator end wall 3, supplies body 2*a* with air for primary combustion purposes. The loading and dumping platform 7 is continuously exposed to the heat radiated from the fire in the drum 2 and is therefore equipped with water cooling means 22, as shown in FIG. 5.

Figure 4:
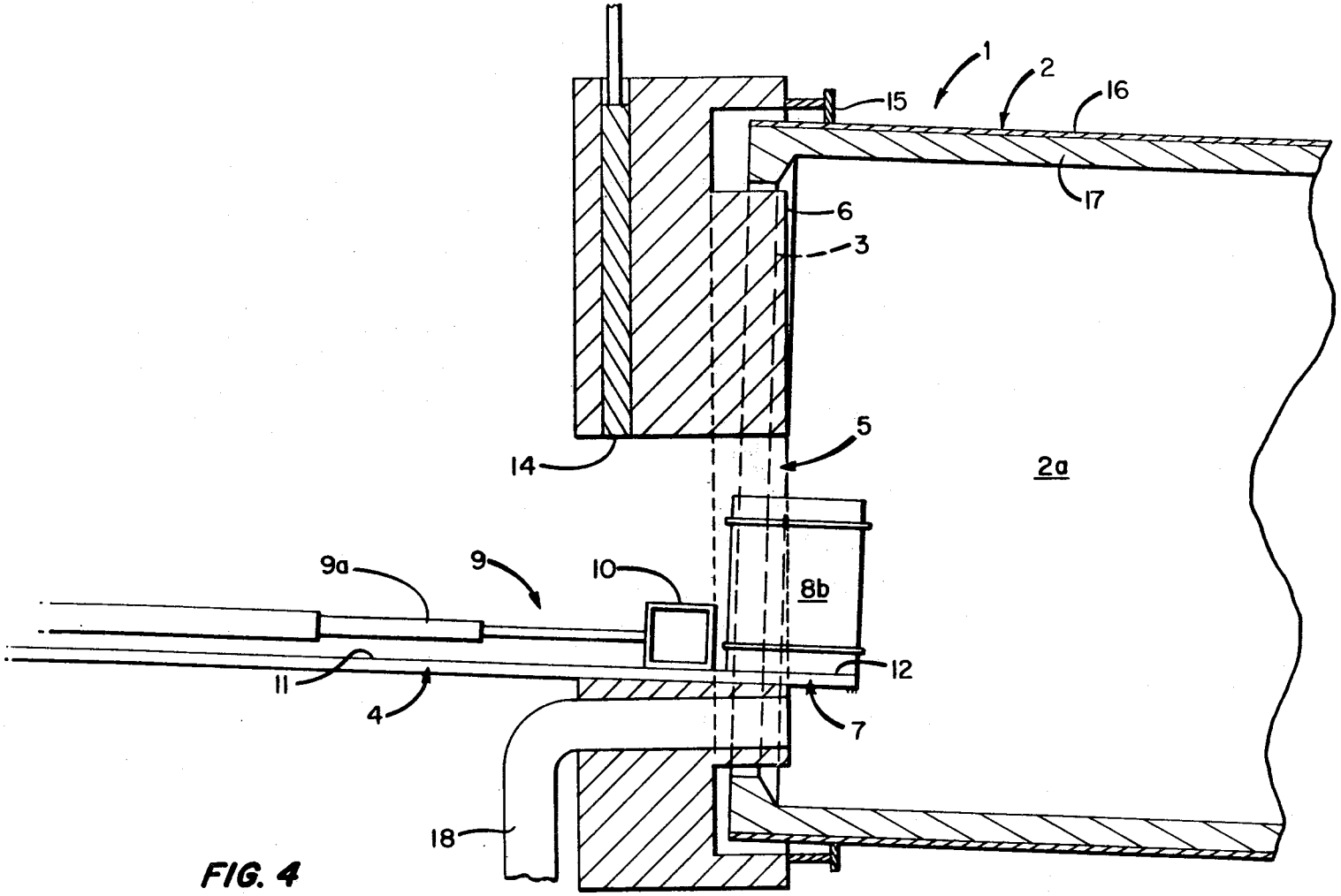
FIG. 4 is a cross-sectional view of another embodiment of the loading device according to the invention.

An alternate embodiment of the loading device comprising the present invention includes shortening the length of loading and dumping platform 7 so that a barrel 8*a* stands adjacent to the inner wall 6 of the rotary (see FIG. 4).

In addition, another embodiment of the loading device comprising the present invention extends the length of loading and dumping platform sufficiently far into the drum 2, that a barrel 8*a* standing on the loading and dumping platform 7 is partially within the drum 2.

Still another embodiment of the new loading device comprises having the water cooled loading and dumping platform 7 inclined at the same angle as the slide 4 as shown in FIG. 4.

Furthermore, another embodiment of the new loading device comprises having the sliding surface 11 of the slide 4 lying in the same plane as the flat surface 12 of the loading and dumping platform 7 as shown in FIG. 4.

Moreover, another embodiment of the new loading device comprises a feed ram 20 (FIG. 5) lying in a vertical plane in front of the ram 9 and at a right angle to the feeding direction of the ram 9 when it retracts into its initial position. This feed ram 20 pushes the barrel 8 from the loading level 13 onto the flat sliding surface 11 of the slide 4.

Still another embodiment of the new loading device comprises adjusting the length of the stroke of the ram 9 or the ram rod 9*a* such that the barrel 8*a*, standing on the loading and dumping platform 7, is given an overturning movement for each stroke or rod length of the ram 9 (see FIGS. 4 and 5). This causes tipping of the barrel 8*a* into the drum 2 before the next barrel 8*b* comes to a stop on the loading and dumping platform 7.

The loading method of the present invention will now be described. A vertical elevator places the open barrel 8*a* in a standing position on loading level 13. The barrel 8*a* is pushed by the ram 9 onto the flat sliding surface 11 on slide 4, through the loading opening 5, and onto loading and dumping platform 7. The sliding door 14 is lowered into its closed position and the barrel 8*a* is allowed to stand on the loading and dumping platform for one loading time interval. The waste contents are subjected to intense heat radiating from fires in the rotary incinerator 1. Because of the intense heat, the combustible and volatile components of the waste material begin vaporizing. The combustible part of the wastes within barrel 8*a* which remain unaffected after this first exposure to heat are considerably reduced in volume by this initial vaporization and have an increased percentage of inert components which favorably affects the subsequent burning time. The remaining combustible waste residue can now be dumped into drum 2 without the danger of over-stressing the rotary incinerator 1. This is achieved by the ram 9 again engaging and pushing barrel 8*a* off the loading and dumping platform 8 and tilting it into the drum 2.

In the preferred embodiment of the loading method described herein, the ram 9 has returned to its initial position, as shown in FIG. 1, while the contents of barrel 8*a* undergoes initial vaporization on the loading and dumping platform 7. The next barrel in sequence, barrel 8*b*, is brought to loading level 13 by the elevator. Using feeding device means directed at right angles to the ram 9, as previously described, but not shown in FIG. 1 for the sake of increased clarity, the barrel 8*b* is pushed onto the surface 11 of the slide 4. Barrel 8*b* is then pushed forward by the ram 9 on slide 4 through the loading opening 5 until it reaches the loading and dumping platform 7. During the last part of its forward movement, the barrel 8*b* first engages, then pushes, and finally tips barrel 8*a*, its combustible contents now initially vaporized, off the loading and dumping platform 7 and into the body 2*a* of drum 2. As barrel 8*a* falls into drum 2, the ram 9 continues to push the barrel 8*b* along the loading and dumping platform 7 until the barrel 8*b* assumes the position previously held by the barrel 8*a*. Therefore, ram 9, a single feeding element, serves a dual purpose: the cyclic feeding of all barrels 8 on slide 4 onto the loading and dumping platform 7 and the cyclic tipping of all barrels 8 into drum 2.

The fall of the barrel 8*a* into drum 2 when tipped off loading and dumping platform 7 is in the direction of arrow D8 as shown in FIG. 1. The fallen drum 8*a* lies on the lower wall or floor of drum 2 parallel to the horizontal axis A2 as shown in FIG. 1, and is prevented from rolling around the drum 2 by a clinker discharge, (not shown). The tipping of the barrel 8*a* off dumping platform 7, and the subsequent movement within drum 2 ensure that the combustible waste residue as well as the non-combustible waste materials in the barrel 8*a* are spread out over the floor of the drum 2.

The loading method described herein requires the cyclic steps of feeding, stopping, vaporizing, and tipping of the barrels 8 to occur at regular time intervals, in sequence, and in continuous repetition. Depending on the barrel's contents, four to fifteen barrels per hour, with an average of nine to ten barrels per hour, can be fed into the rotary incinerator 1 using the loading method described herein. It is imperative that the contents of the barrels be exposed to an optimum degree of heat radiation while on the dumping and loading platform 7 during each loading time interval. The initial vaporization and partial gasification of wastes while on the loading platform 7 permits a more uniform release of heat and a more constant operation of the entire incinerator facility than possible with the previously known loading methods and devices.

Referring to FIG. 2, the release of heat for the waste contents of individual barrels is shown schematically comparing the loading methods previously known with the present invention on a side by side comparison basis. Using a rectangular system of coordinates, FIG. 2 shows an abscissa 24, representing time (t) in hours (h) for the known methods and the present invention for two successive loading time intervals t1 and t2. The ordinate 25 of the graph shows the corresponding release of heat, the amount of thermal furnace output Q in Gcal/h. In FIG. 2, the past released per barrel by the previously known method is represented by a curve 26 while the heat released per barrel by the present invention's method of loading is represented by a curve 27.

In the previously known loading method, immediately after the barrel is tipped into the rotary incinerator corresponding to loading time interval t1, an uncontrollable, sudden release of heat takes place in the body of the furnace. This is due to the relatively large surface area of the combustible waste material and the intensive heat prevailing in the drum. This sudden heat release results in a steep, high temperature peak shown in curve 26 subjecting the rotary incinerator to severe stress within a short time period during the first loading time interval t1. Admittedly, these temperature peaks, as in curve 26, can be made harmless by using an overly large incinerator design permitting the maximum permissible thermal furnace output 28 possible in a rotary incinerator. However, in view of the short duration of the heat-stress peaks in curve 26, this would entail unnecessary investment costs. On the other hand, if a rotary incinerator having a thermal furnace output 30 were designed only to withstand the average heat stress 29, as is in fact the usual practice to avoid unnecessary costs, the incinerator would be still subjected to the temperatures as shown in curve 26 and have its lifetime correspondingly reduced. In addition, there are the previously described disadvantages of frequent oxygen shortages and unacceptable soot build-ups. Thus, the maximum design output 28 of an incinerator structured to withstand the temperature peaks as shown by curve 26, can be used as the nominal model design but in practice such an incinerator has a true design output 30, able to meet only the average heat stress 29, and is the actual design normally employed.

In comparison, when using the present invention's loading method, temperature peaks like curve 26 can no longer occur during the first loading time interval t1. During this period of time, the barrel is standing upright on the loading and dumping platform undergoing the first exposure to heat resulting in a partial gasification and initial combustion of the volatile components as previously described. Thus only a partial release of heat occurs in comparison with the previously known loading method. This is shown in FIG. 2 by the heat release curve branch 31 in the first loading time interval t1 which increases only gradually up to a relatively low level in the second loading time interval t2.

The combustible waste residue remaining in the barrel after the initial exposure to heat during the first loading interval t1 is so reduced by the partial gasification that it can now be fed directly into the incinerator drum without the danger of over-stressing the rotary incinerator by excessive heat. The second time interval t2, where the combustible waste residue is extensively spread over the lower wall or floor of the drum, shows a gradual further increase of released heat as indicated by curve branch 32 of heat release curve 27. In comparison with temperature peak curve 26 of the previously known loading method, the heat increase is very small. In any case, such pronounced temperature peaks as in curve 26, the result of discharging waste barrels directly into the incinerator, are completely avoided by the present invention's loading method.

FIG. 2 also shows that if the combustion arrangement in the present invention were to be used in an incinerator constructed in accordance with the prior art having a maximum thermal output 30, such that the maximum permissable heat output 30 will not be reached at any point by heat release curve 27 over the entire range of loading time intervals t1 and t2 so that a measure of heat safety would be provided. It is only by this new loading method that a rotary furnace can be optimally utilized without a disadvantageous stress effect. However, no loss of waste burning efficacy occurs with this design. Since the total effective amount of heat liberated during the combustion of one barrel's waste contents according to the present invention is exactly the same quantity of heat as that released by the previously known method (assuming the same barrel contents and calorific value), the shaded area 34 enclosed by heat release curve 27 using the present invention is the same quantity of heat as that within shaded area 35 on heat release curve 26 using the previously known method.

Figure 3:
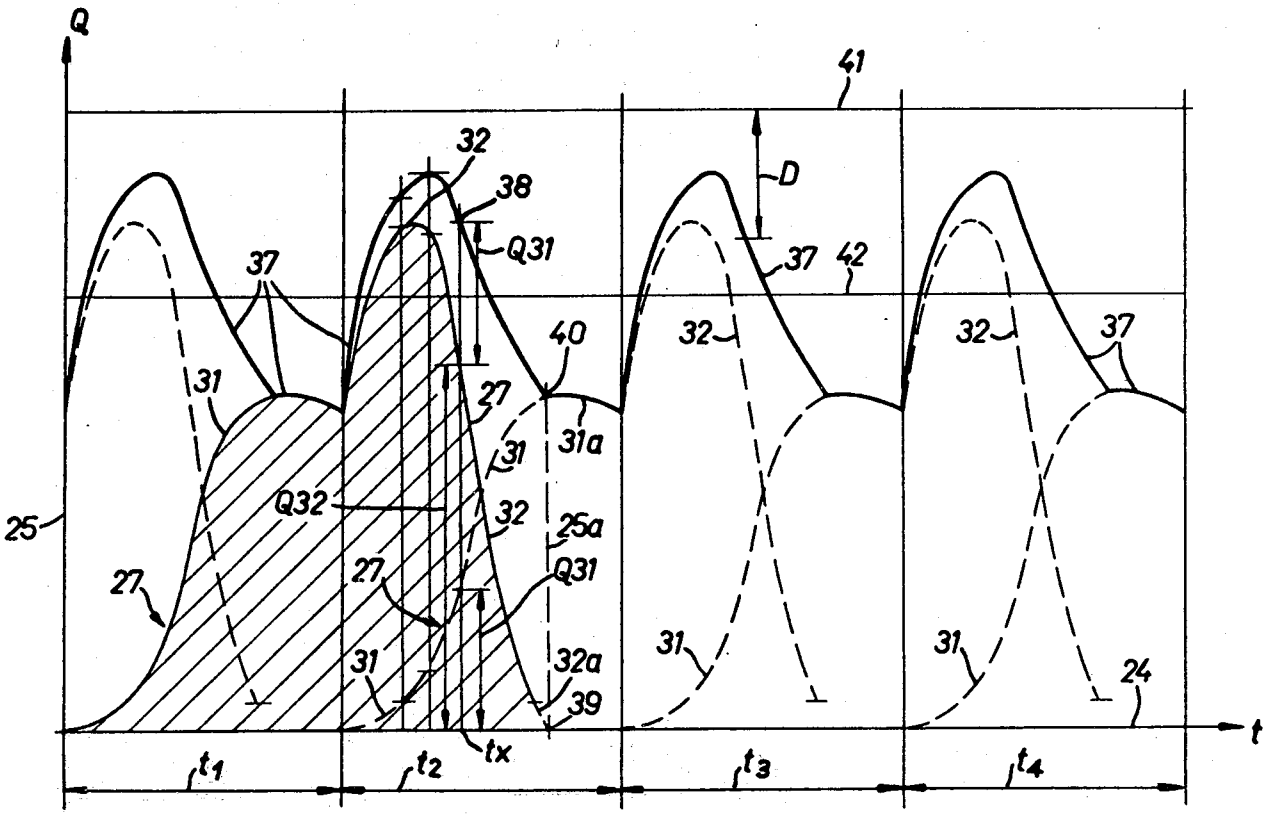
FIG. 3 is a graph comparing the entire waste combustion process over successive time intervals and the effective heat stress on a rotary incinerator using the new loading method.

Referring to FIG. 3, a graph is provided showing a time segment from the total combustion process during incinerator operation and the effective heat stress on the rotary incinerator using the loading method of the present invention. Here, the abscissa 24 represents time (t) in hours (h) and is used to plot the successive loading in time intervals t1 through t4, while the ordinate 25 shows the corresponding heat release, Q in Gcal/h. The curve of effective heat release during incinerator operation results from the addition of the individual heat release curve 27 for each of the individually loaded barrels and is produced by the successive, periodic, barrel by barrel loading of the incinerator. Each loading is staggered in time by one loading time interval as explained herein with reference to curve 27 in FIG. 2 and is shown in FIG. 3 as a thick solid line 37.

At the beginning of loading time interval t1, a single barrel is fed onto the loading and dumping platform whereupon the heat release from this barrel is in accordance with curve 27. This heat release curve 27 is again composed of curve branch 31, located in the first loading time interval t1, indicating the initial combustion of the waste contents of the barrel while standing on the loading and dumping platform; this is followed by curve branch 32, located in the second loading time interval t2, indicating the heat release from the combustible waste residue lying on the lower wall or floor of the drum. At the beginning of the second loading time interval t2, two events occur simultaneously: not only does the release of heat from the combustible waste residue dumped into the drum from the tipped barrel begin, but the second heat release curve 27 coming from the next barrel in sequence begins. This is indicated by heat release curve 31 which indicates the heat release from the second barrel in sequence which has now been placed on the loading and dumping platform. These two separate and simultaneous heat curves 31 and 32 must be added together for every point in time as shown in FIG. 3. At each point in time tx the amount of heat Q32 from curve branch 32 of the first incinerator loading is combined with the corresponding amount of heat Q31 from the curve branch 31 of the subsequent second incinerator loading. The points obtained by this super positioning of the two quantities of heat Q31 and Q32 provide the instantaneous value of the true total effective heat release at any given point in time, tx. The true cumulative quantity of heat released in the drum is designated 38 and is indicated by curve 37 in FIG. 3. This super positioning of two quantities of heat released, one from each of the two curve branches 31 and 32 for loading interval t2, is repeated in each of the two subsequent loading time interval t3 and t4. At any point in time the effective heat released from each source varies, changing the corresponding total effective heat release curve 37 as shown by the thick solid line in FIG. 3.

In the loading time interval t2, the lowermost part of curve branch 32 will, in theory, gradually and nearly asymptotically approach the horizontal abscissa 24. However, for the sake of increased clarity, the descending part of curve branch 32 and dashed short line 32*a* is brought down as an interpolation at point 39 on the abscissa 24 indicating a heat release value of zero. This shows clearly and unambiguously the effective heat release which takes place toward the end of loading time interval t2.

If, as is assumed, the heat release from the first barrel reaches a value of zero when curve 27 reaches point 39 on the abscissa, the cumulative effect of the curve branches 31 and 32 within the loading time interval likewise comes to an end. For the remainder of any time interval, there is only the heat release curve 31 obtained from the barrels standing on the loading and dumping platform. Only at the beginning of the next loading time interval does the cumulative heat release effect begin anew. Therefore, before the end of loading time interval t2, the curve 31*a* seems to be superimposed at a point 40 on effective heat release curve 37. Point 40 is obtained as the intersection of ordinate 25*a* which passes through abscissa point 39 and curve branch 31. The relatively short part of the curve located between point 40 and the beginning of the next loading time interval t3, is represented by curve 31*a*. From curve 31*a* spring both the curve branch 31, curve 27, and the total effective heat release curve 37 at the beginning of the next loading time interval t3. At that time period, the initial combustion phase of the next barrel in sequence releases additional heat and the curve branches 31 and 32 are again identified as has already been previously explained for loading time interval t2. The sequence of events is repeated periodically for each loadng time interval so long as barrels of combustible wastes are fed into the rotary incinerator.

In FIG. 3, the assumed maximum permissible heat output of the incinerator in Gcal/h is designated 41. The wavelike pulsations in the effective heat release curve 37, caused by the successive chronological phase shifts in heat release curve 27 for each of the barrels successively fed into the drum, results in an average heat stress 42. Should the maximum heat output 41 be desired, controlled combustion of additional waste material is possible. For example, a controlled supply of liquid waste can be burned until the desired constant temperature or maximum permissible heat stress 41 is obtained. The heat produced by this additional controlled waste combustion of a liquid corresponds to the difference D between curve 37 and the maximum effective continuous heat stress 41.

It should be appreciated that additions and modifications to the preferred embodiment described herein may be made by those skilled in the art without narrowing the scope of the invention. Accordingly, the invention is to be limited only as indicated by the appended claims.

What is claimed is:

1. A loading method for feeding waste-filled containers into a rotary incinerator, said method comprising the steps of:

placing a waste-filled, open topped container on a slide;

feeding the waste-filled container along the slide through a loading opening in an end wall of the incinerator;

positioning the waste-filled container on a loading and dumping platform projecting into a drum of the rotary incinerator;

allowing the waste-filled container to stand on the loading and dumping platform exposed to heat within the drum for a predetermined loading time interval; and tipping the waste-filled container off the loading and dumping platform onto a floor of the drum at the end of the predetermined loading time interval.

2. The loading method recited in claim 1 wherein the tipping step further comprises:

using a second waste-filled container in sequence to tip the first waste-filled container into the drum; and setting the second waste-filled container on the loading and dumping platform at the position previously held by the first container.

3. A loading device for feeding open-topped, waste-filled containers into a rotary incinerator, said incinerator comprising a stationary end wall, a stationary inner wall, a rotary drum, and a loading opening through said end wall and said inner wall to said drum, wherein the improvement comprises:

a loading and dumping platform projecting from the stationary inner wall and extending sufficiently far into the rotary drum above a drum lower wall as to encounter intense heat within said drum;

slide means merging with said loading and dumping platform at the stationary end wall; and reciprocating means in contact with said slide means for feeding waste-filled containers sequentially onto the loading and dumping platform, for allowing each waste-filled container to stand on the loading and dumping platform exposed to heat within the drum for a predetermined loading time interval, and for tipping each waste-filled container from the loading and dumping platform and onto a floor of the drum after passage of the predetermined loading time interval.

4. The loading device recited in claim 3 wherein the reciprocating means comprises a ram.

5. The loading device recited in claim 4 wherein said ram comprises a ram head and a ram rod.

6. The loading device recited in claim 3 wherein a loading level for receiving waste-filled containers is disposed upon said slide means.

7. The loading device recited in claim 3 wherein a loading level for receiving waste-filled containers is disposed adjacent to said slide means.

8. The loading device recited in claim 3 wherein said loading and dumping platform projects sufficiently far into the drum that a container standing on said platform is at least partially inside the body of the drum.

9. The loading device recited in claim 3 wherein said loading and dumping platform projects sufficiently into the drum that a container standing on the platform is located adjacent to said stationary inner wall.

10. The loading device recited in claim 3 wherein said loading and dumping platform is provided with water cooling means.

11. The loading device recited in claim 10 wherein said loading and dumping platform has the same slope as said slide means.

12. The loading device recited in claim 10 wherein said loading and dumping platform and said slide means lie in the same plane.

13. The loading device recited in either of claims 6 or 7 and further comprising feeding means to transport waste-filled containers from said loading level onto said slide means.

14. The loading device recited in claim 3 wherein said reciprocating means are adjustable and exert an overturning movement on each waste-filled container standing on said loading and dumping platform.

15. A loading method for feeding waste-filled containers into a rotary incinerator comprising a drum, said method comprising the steps of:

placing waste-filled, open topped containers on a slide;

feeding waste-filled containers sequentially along the slide through a loading opening in the end wall of the incinerator;

advancing one waste-filled container to a position on a loading and dumping platform projecting into the drum of the rotary incinerator;

allowing the one container to stand on the loading and dumping platform exposed to heat within the drum for a predetermined time interval; and tipping the one container off the loading and dumping platform and onto its side on the floor of the drum by advancing another container to the position of the one container on the loading and dumping platform.

16. A loading device for feeding open topped, waste-filled containers into a rotary incinerator said incinerator comprising a stationary end wall, a stationary inner wall, a rotary drum, and a loading opening through said end wall and said inner wall to said drum, wherein the improvement comprises:

a loading and dumping platform projecting from the stationary inner wall and extending sufficiently far into the rotary drum above the drum lower wall as to encounter intense heat within said drum;

slide means merging with said loading and dumping platform at the stationary end wall; and reciprocating means in contact with said slide means for individually feeding waste-filled containers to a position on the loading and dumping platform, for allowing each waste-filled container to stand in said position on the loading and dumping platform exposed to heat within the drum for a predetermined loading time interval, and for subsequently tilting each container individually onto its side on the lower wall of the drum by feeding another waste-filled container to said position on the loading and dumping platform.

* * * * *

UNITED STATES PATENT AND TRADEMARK OFFICE

CERTIFICATE OF CORRECTION

PATENT NO. : 4,315,712

DATED : Feb. 16, 1982

INVENTOR(S) : Werner Seglias

It is certified that error appears in the above—identified patent and that said Letters Patent is hereby corrected as shown below:

Column 3, line 52-53, "slide 4 as shown in FIG.4" should read --slide 4, as shown in FIG. 1.

Column 3, line 57, "platform 7 as" should read --platform 7, as--.

Signed and Sealed this

*Fifteenth* Day of *March 1983*

[SEAL]

*Attest:*

GERALD J. MOSSINGHOFF

*Attesting Officer*

*Commissioner of Patents and Trademarks*